US010662756B2

(12) United States Patent
Abdelmoula et al.

(10) Patent No.: US 10,662,756 B2
(45) Date of Patent: May 26, 2020

(54) APPARATUS AND METHOD FOR HYBRID SONIC TRANSMITTER INTEGRATED WITH CENTRALIZER FOR CEMENT BOND LOG CASED-HOLE APPLICATION

(71) Applicant: GOWell International, LLC, Houston, TX (US)

(72) Inventors: Hichem Abdelmoula, Houston, TX (US); Qinshan Yang, Katy, TX (US)

(73) Assignee: GOWell International, LLC, Houston, TX (US)

( * ) Notice: Subject to any disclaimer, the term of this patent is extended or adjusted under 35 U.S.C. 154(b) by 178 days.

(21) Appl. No.: 15/875,035

(22) Filed: Jan. 19, 2018

(65) Prior Publication Data

US 2019/0226318 A1 Jul. 25, 2019

(51) Int. Cl.

| | |
|---|---|
| ***E21B 47/00*** | (2012.01) |
| ***E21B 47/14*** | (2006.01) |
| *E21B 17/10* | (2006.01) |

(52) U.S. Cl.

CPC ..... *E21B 47/0005* (2013.01); *E21B 47/14* (2013.01); *E21B 17/1014* (2013.01); *E21B 17/1057* (2013.01)

(58) Field of Classification Search

CPC .. G01V 3/28; G01V 1/50; E21B 47/00; E21B 47/14; E21B 17/1014; E21B 17/1057; E21B 17/1078

See application file for complete search history.

(56) References Cited

U.S. PATENT DOCUMENTS

| | | | | |
|---|---|---|---|---|
| 2017/0254916 | A1* | 9/2017 | Yu | E21B 17/1078 |
| 2017/0350231 | A1* | 12/2017 | Merciu | G01V 1/50 |
| 2017/0350999 | A1* | 12/2017 | Merciu | E21B 47/00 |
| 2018/0128930 | A1* | 5/2018 | Zhao | G01V 1/50 |

* cited by examiner

*Primary Examiner* — Lisa M Caputo
*Assistant Examiner* — Nigel H Plumb
(74) *Attorney, Agent, or Firm* — Tumey L.L.P.

(57) ABSTRACT

A method and system for inspecting cement downhole. The method may comprise inserting an inspection device inside a tube. The inspection device may comprise a centralizing module as well as a tapper attached to the centralizing module. The inspection device may further comprise a receiver, a micro controller unit, and a telemetry module. The method may further comprise actuating the tapper, wherein the tapper produces a nonlinear wave, recording reflections of acoustic waves off a tubing or a casing, and creating a graph with an information handling system for analysis. An inspection device may comprise a centralizing module and a tapper attached to the centralizing module. The inspection device may further comprise a receiver, an information handling system, and a memory module.

20 Claims, 6 Drawing Sheets

APPARATUS AND METHOD FOR HYBRID SONIC TRANSMITTER INTEGRATED WITH CENTRALIZER FOR CEMENT BOND LOG CASED-HOLE APPLICATION

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

Field of the Disclosure

This disclosure relates to a field for a downhole tool that may be capable of detecting in cement, bad interfaces between casing and cement, and/or bad interfaces between cement and a formation. Processing recorded nonlinear acoustic waves generated by a tapper may help identify properties within tubing, casing, cement, and/or a formation.

Background of the Disclosure

Tubing may be used in many different applications and may transport many types of fluids. Tubes may be conventionally placed underground and/or positioned in an inaccessible area, making inspection of changes within tubing difficult. Additionally, tubing may be surrounded and/or encased by a casing and/or cement. It may be beneficial to measure the thickness of the surrounding cement and/or the interface between the casing and the cement. Previous methods for inspecting cement have come in the form of non-destructive inspection tools that may transmit linear acoustic waves that may be reflected and recorded for analysis. Previous methods may not be able to perform measurements of the interface between casing and cement. Without limitation, different types of transmitters may be utilized in an inspection tool. A tapper may be well suited for multiple types of inspection because it may operate in gas well as well as highly attenuated wells.

Previous devices and methods for sonic wave generation relied on a sonic transmitter installed on the same axis as the device to which the sonic transmitter is attached. Such sonic transmitters are able emit an azimuthal sonic wave to be reflected by the casing and then received by hydrophones. However, this emitted sonic wave may not reach the surface of the casing due to the absence of a propagation medium (such as in gas well) or due to the high values of medium attenuation (such as in muddy wells). Another drawback of such previous devices and methods for sonic wave generation is the possibility of interference by the emitted wave with the received wave. For this reason, complex signal treatment of the received signals is required, in addition to a well-defined apparatus, to be able to distinguish the emitted sonic wave from an echo generated by the casing.

Consequently, there is a need for an inspection device and methods that may be able to generate a reflected sonic wave on the casing through a mechanical excitation. Using this mechanism, a uniform sonic wave is ensured to be reflected from the casing independently of the medium inside the pipeline. The reflected wave may contain information about the type of formation behind a first casing. Moreover, the absence of an emitted wave removes problems related to the ringing of a transmitter or possible interference between the emitted wave and received wave. Further, using mechanical excitation may eliminate the need for a transmitter, reduce the tool length of the downhole tool being used, and reduce tool power consumption. Also, in downhole applications, an inspection device with a tapper may be capable of determining properties of tubing, cement, properties of cement, and the adhesion between casing and cement in gas wells and highly attenuated wells, which may be in high demand.

BRIEF SUMMARY OF SOME OF THE PREFERRED EMBODIMENTS

These and other needs in the art may be addressed in embodiments by a device and method for processing measurements recorded by an inspection device.

A method for inspecting cement downhole may comprise inserting an inspection device inside a tube. The inspection device may comprise a centralizing module as well as a tapper attached to the centralizing module. The inspection device may further comprise a receiver, a micro controller unit, and a telemetry module. The method may further comprise actuating the tapper, wherein the tapper produces a nonlinear wave, recording reflections of acoustic waves off a tubing or a casing, and creating a graph with an information handling system for analysis.

A method for inspecting cement downhole may comprise inserting an inspection device inside a tube. The inspection device may comprise a centralizing module as well as a tapper attached to the centralizing module. The inspection device may further comprise a receiver, a micro controller unit, and a telemetry module. The method may further comprise actuating the tapper, wherein the tapper produces a nonlinear wave, and recording reflections of acoustic waves off a tubing or a casing.

An inspection device may comprise a centralizing module and a tapper attached to the centralizing module. The inspection device may further comprise a receiver, an information handling system, and a memory module.

The foregoing has outlined rather broadly the features and technical advantages of the present invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other embodiments for carrying out the same purposes of the present invention. It should also be realized by those skilled in the art that such equivalent embodiments do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

The present disclosure relates to embodiments of a device and method for inspecting and detecting properties of cement attached to casing. More particularly, embodiments of a device and method are disclosed for inspecting any number of cement walls surrounding an innermost tubing. In embodiments, an inspection device may generate acoustic waves in surrounding casing and cement, which may reflect the acoustic waves for recording. The recorded acoustic waves may be analyzed for aberrations and/or properties of the cement. Acoustic waves may be produced by a tapper, which may be switched on and off to produce acoustic waves in a casing and/or surrounding cement walls. The acoustic wave diffusion and/or reflection in the casing and/or surrounding cement may be recorded, specifically nonlinear acoustic waves, which may be processed to determine the location of aberrations within the cement, which may comprise inadequate tubing and cement adhesion, inadequate cement and formation adhesion, cracks in the cement, and/or the like.

Figure 1:
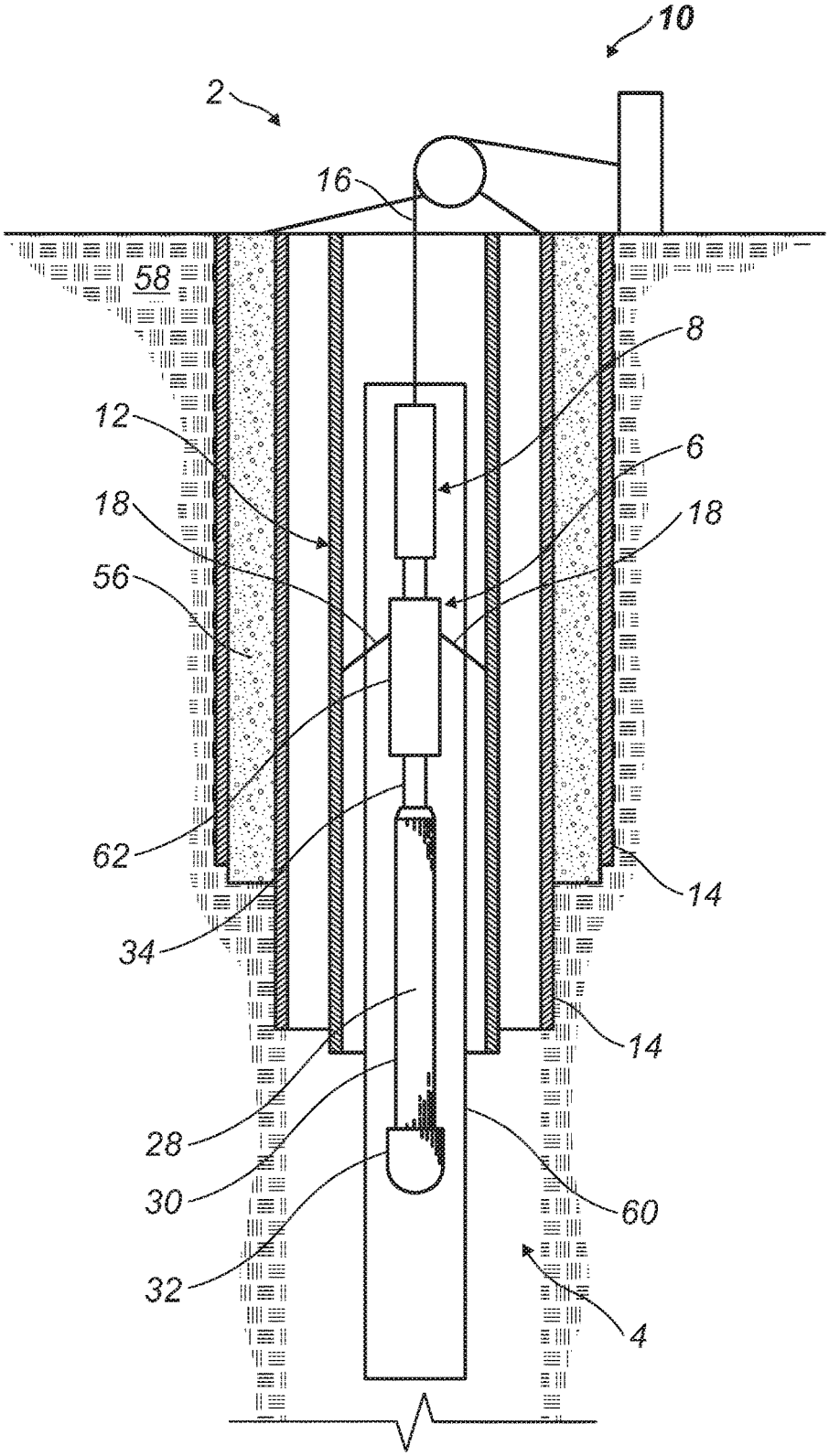
FIG. 1 illustrates an embodiment of an inspection system disposed downhole.

FIG. 1 illustrates an inspection system 2 comprising an inspection device 4, a centralizing module 6, a telemetry module 8, and a service device 10. In embodiments, inspection device 4 may be inserted into a tubing 12, wherein tubing 12 may be contained within a casing 14. In further embodiments, there may be a plurality of casing 14, wherein tubing 12 may be contained by several additional casing 14. In embodiments, as shown, an acoustic receiver 32 may be disposed below centralizing module 6 and telemetry module 8. In other embodiments, not illustrated, acoustic receiver 32 may be disposed above and/or between centralizing module 6 and telemetry module 8. In embodiments, inspection device 4, centralizing module 6, and telemetry module 8 may be connected to a tether 16. Tether 16 may be any suitable cable that may support inspection device 4, centralizing module 6, and telemetry module 8. A suitable cable may be steel wire, steel chain, braided wire, metal conduit, plastic conduit, ceramic conduit, and/or the like. A communication line, not illustrated, may be disposed within tether 16 and connect inspection device 4, centralizing module 6, and telemetry module 8 with service device 10. Without limitation, inspection system 2 may allow operators on the surface to review recorded data in real time from inspection device 4, centralizing module 6, and telemetry module 8.

As illustrated in FIG. 1, service device 10 may comprise a mobile platform (i.e. a truck) or stationary platform (i.e. a rig), which may be used to lower and raise inspection device 4. In embodiments, service device 10 may be attached to inspection device 4 by tether 16. Service device 10 may comprise any suitable equipment that may lower and/or raise inspection device 4 at a set or variable speed, which may be chosen by an operator. The movement of inspection device 4 may be monitored and recorded by telemetry module 8.

Telemetry module 8, as illustrated in FIG. 1, may comprise any devices and processes for making, collecting, and/or transmitting measurements. For instance, telemetry module 8 may comprise an accelerator, gyro, and the like. In embodiments, telemetry module 8 may operate to indicate where inspection device 4 may be disposed within tubing 12 and the orientation of a tapper 17, illustrated in FIG. 1A, and acoustic receiver 32, discussed below. Telemetry module 8 may be disposed at any location above, below, and/or between centralizing module 6 and acoustic receiver 32. In embodiments, telemetry module 8 may send information through the communication line in tether 16 to a remote location such as a receiver or an operator in real time, which may allow an operator to know where inspection device 4 may be located within tubing 12. In embodiments, telemetry module 8 may be centered about laterally in tubing 12.

As illustrated in FIG. 1, centralizing module 6 may be used to position inspection device 4 and/or telemetry module 8 inside tubing 12. In embodiments, centralizing module 6 laterally positions inspection device 4 and/or telemetry module 8 at about a center of tubing 12. Centralizing module 6 may be disposed at any location above and/or below telemetry module 8 and/or acoustic receiver 32. In embodiments, centralizing module 6 may be disposed above acoustic receiver 32 and below telemetry module 8. Centralizing module 6 may comprise one or more arms 18. In embodiments, there may be a plurality of arms 18 that may be disposed at any location along the exterior of centralizing module 6. Specifically, arms 18 may be disposed on the exterior of centralizing module 6. In an embodiment, as shown, at least one arm 18 may be disposed on opposing lateral sides of centralizing module 6. Additionally, there may be at least three arms 18 disposed on the outside of centralizing module 6. Arms 18 may be moveable at about the connection with centralizing module 6, which may allow the body of arm 18 to be moved closer and/or farther away from centralizing module 6. Arms 18 may comprise any suitable material. Suitable material may be, but is not limited to, stainless steel, titanium, metal, plastic, rubber, neoprene, and/or any combination thereof.

Figure 1A:
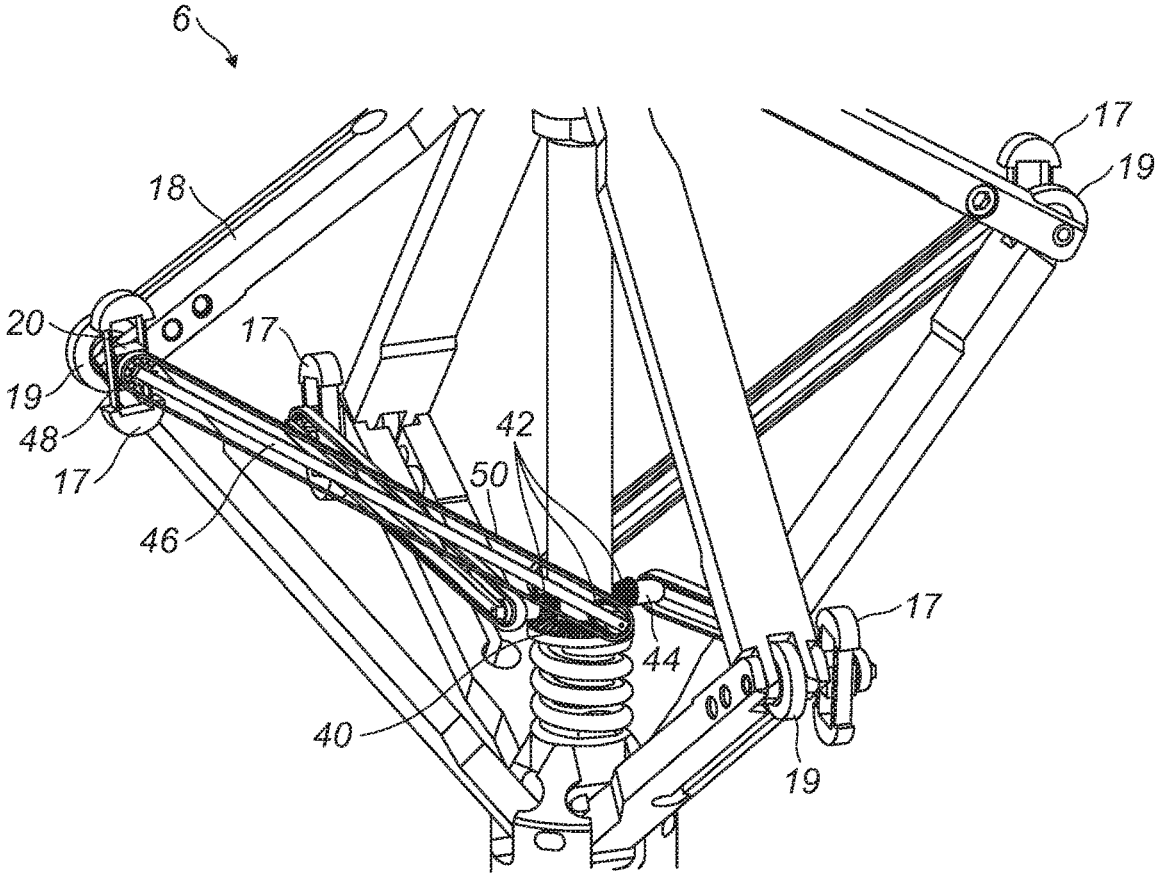
FIG. 1A illustrates an embodiment of a centralizing module with a tapper.

As illustrated in FIG. 1A, one or more tappers 17 may be attached to centralizing module 6. Tapper 17 is capable of generating a periodic impulse on tubing 12. Tapper 17 may be actuated mechanically or electrically in order to generate different apertures. An aperture is a portion of a data set, such as seismic data, to which functions or filters are applied.

Figure 1B:
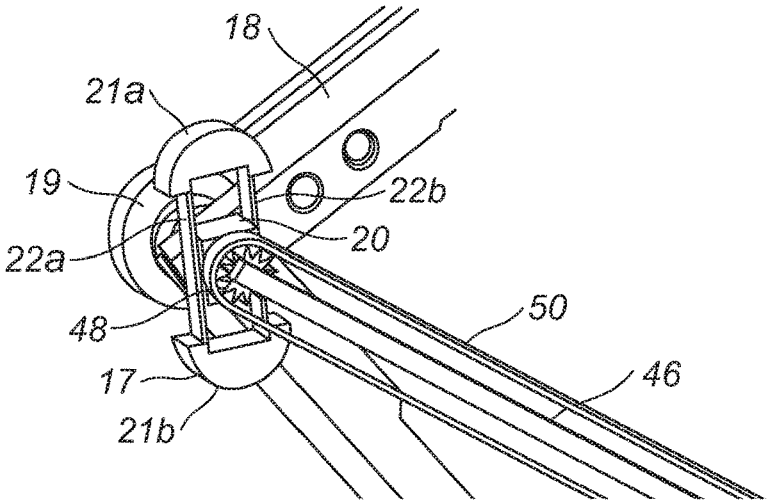
FIG. 1B is an exploded view of an embodiment of a centralizing module with a tapper.

As illustrated in FIGS. 1A and 1B, tapper 17 may be mechanically actuated by rotation of a wheel 19 of centralizing module 6. In embodiments, a circular rack 40 encircles the axis of centralizing module 6. Rack 40 is capable of rotating and translating along the axis of centralizing module 6. A first pinion gear 42 is connected to rack 40, and a first shaft 44 is connected to first pinion gear 42. First pinion gear 42 is capable of translating according to the axis of the centralizing module 6 and rotating according to the perpendicular axis of rack 40. First shaft 44 is attached to an elongated member 46, and elongated member 46 is attached to a second pinion gear 48. Further, a belt 50 coordinates the movement of first shaft 44 and second pinion gear 48. Second pinion gear 48 is connected to tapper 17, which in turn is attached to arm 18 with wheel 19.

Figure 1C:
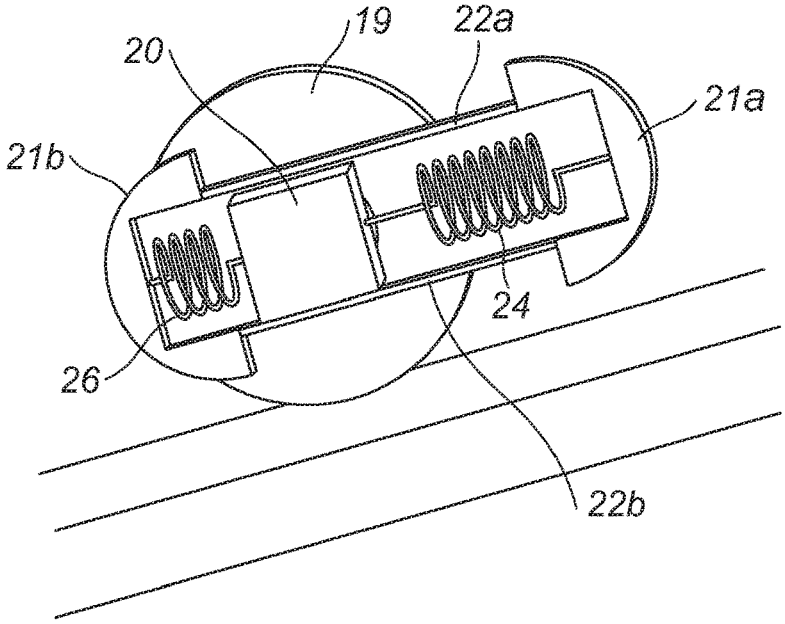
FIG. 1C illustrates an embodiment of a tapper.

As illustrated in FIGS. 1A, 1B, and 1C, tapper 17 has a square 20 at its center. Tapper 17 has two ends, an end 21*a* and an end 21*b*. Ends 21*a* and 21*b* each have an outside semicircular shape. Ends 21*a* and 21*b* each have an interior shape that includes a portion for receiving square 20. Ends 21*a* and 21*b* are connected to each other by a member 22*a* and a member 22*b*. The distance from member 22*a* to member 22*b* is roughly the same distance as one side of square 20. Members 22*a* and 22*b* are capable of sliding along square 20, and the interiors of ends 21*a* and 21*b* are capable of accepting part of square 20. Additionally, tapper 17 may have at least two compression springs, a first compression spring 24 and a second compression spring 26. One end of first compression spring 24 is attached to the inside of end 21*a*, and the other end of first compression spring 24 is attached to square 20. Likewise, second compression spring 26 is attached to the inside of end 21*b*, and the other end of second compression spring 26 is attached to square 20.

In operation, wheel 19 may be in contact with tubing 12 for a period of time and out of contact for a period of time. During the period of time when wheel 19 is in contact with tubing 12, wheel 19 rotates causing, for example, one end of tapper 17 to contact tubing 12. For example, as end 21*a* comes into contact with tubing 12, end 21*a* is forced to align with the edge of wheel 19. At the same time, as end 21*a* aligns with the edge of wheel 19, first compression spring 24 starts to compress. While end 21*a* moves toward alignment with wheel 19, end 21*b* moves away from tubing 12 and second compression spring 26 expands. Further, the contact between end 21*a* of tapper 17 and tubing 12 generates an acoustic wave. As wheel 19 continues to rotate along tubing 12, end 21*a* rotates along tubing 12 and then begins to cease contact with tubing 12. The lack of forced contact with tubing 12 allows first compression spring 24 to begin expanding, and end 21*a* is no longer in aligning with wheel 19. As wheel 19 continues to rotate, end 21*b* comes into contact with tubing 12, and second compression spring 26 is compressed until end 21*b* is in alignment with wheel 19. End 21*b* coming into contact with tubing 12 likewise generates an acoustic wave. This process continues while wheel 19 remains in contact with tubing 12. The rack-and-pinion system including rack 40 and first pinion gear 42 and second pinion gear 48 allow coordination between multiple tapper 17, when more than one tapper 17 is employed.

Figure 1D:
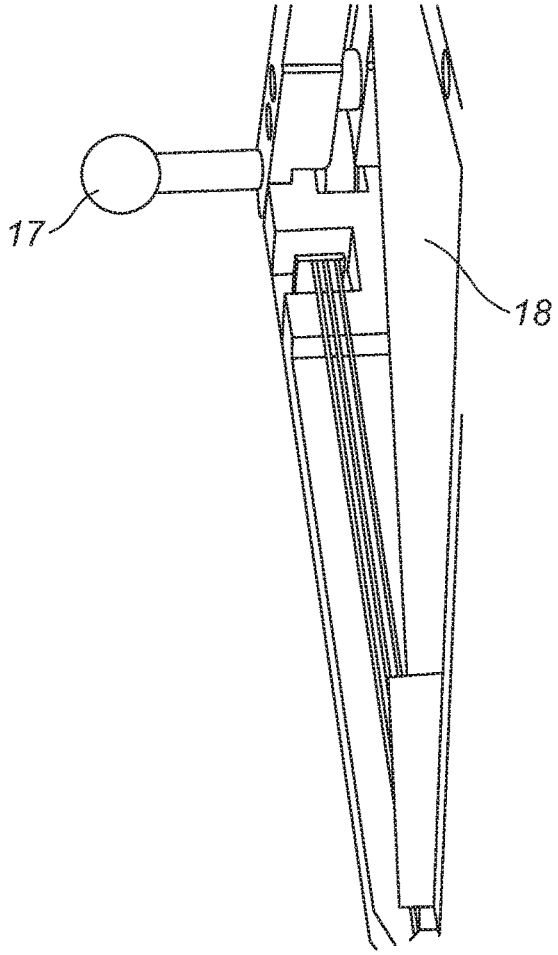
FIG. 1D illustrates an alternative embodiment of a centralizing module arm with a tapper.
Figure 1E:
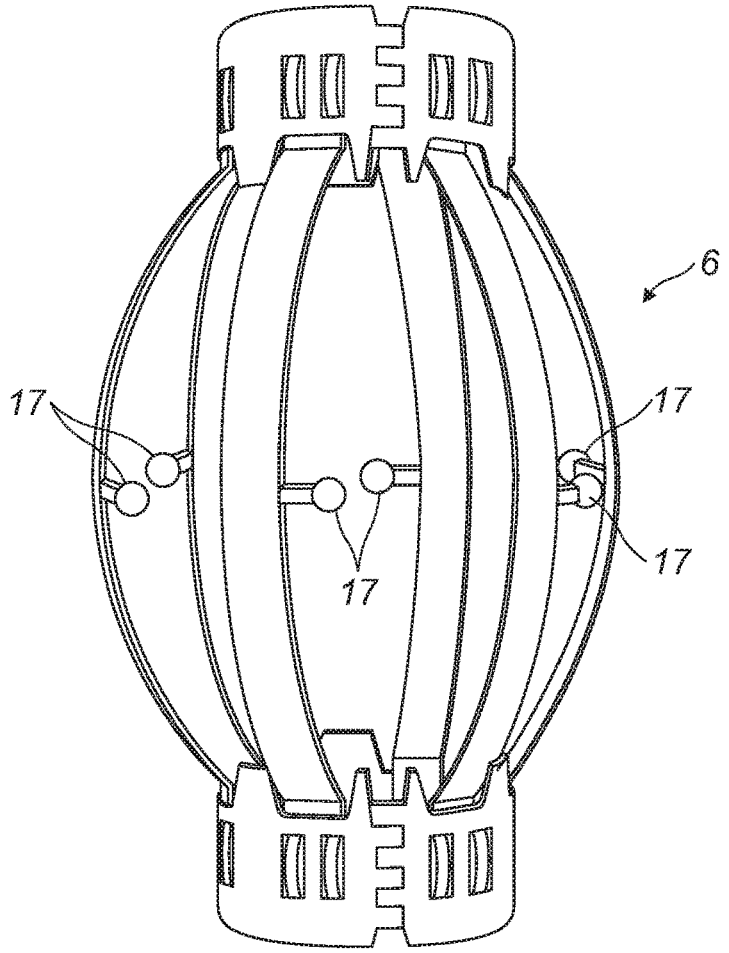
FIG. 1E illustrates an alternative embodiment of a centralizing module with a tapper.

In an alternative embodiment, as illustrated in FIG. 1D, tapper 17 is electrically actuated by a motor 54 (not shown). In this alternative embodiment, electricity is provided to power motor 54. Motor 54 is capable of oscillating arms 18 of centralizing module 6 to an angle. In embodiments, tapper 17 is attached to one or more arms 18. Tapper 17 may be electrically actuated using motor 54 to contact tubing 12 and generate an acoustic wave. The ability to oscillate arms 18 allows for different angles of contact between tapper 17 and tubing 12. In embodiments, certain mechanical constraints may be imposed on the dimensions of tapper 17 depending on the size of tubing 12. In certain embodiments, the electrically actuated tapper 17 does not exceed 1 inch in length with a 20-degree angle of oscillation. In embodiments, the end of electrically actuated tapper 17 is roughly spherical in shape. Additionally, tapper 17 may be capable of being actuated symmetrically or asymmetrically. During a symmetrical actuation, tubing 12 is contacted by more than one tapper 17. During an asymmetrical actuation, tubing 12 is contacted by only one tapper 17. In an alternative embodiment, as illustrated in FIG. 1E, centralizing module 6 may be a bow-spring centralizer when using electrically actuated tapper 17.

Inspection device 4, as illustrated in FIG. 1, may be able to determine the location of aberrations within a cement 56, which may comprise inadequate tubing 12 and cement 56 adhesion, inadequate cement 56 and a formation 58 adhesion, cracks in cement 56, and/or the like. In embodiments, inspection device 4 may be able to detect, locate transverse and longitudinal defects (both internal and external), and/or determine the deviation of the wall thickness from its nominal value thorough the interpretation of recorded acoustic waves. Tubing 12 may be made of any suitable material for use in a wellbore. Suitable material may be, but is not limited to, metal, plastic, and/or any combination thereof. Additionally, any type of fluid may be contained within tubing 12 such as, without limitation, water, hydrocarbons, and the like. Further, inspection device 4 is capable of performing cement evaluation in gas wells and highly attenuated wells, e.g., muddy wells, wells with high solid content, etc. In embodiments, there may be additional casing 14 that may encompass tubing 12. Further, inspection device 4 may comprise a housing 60 in which a memory module 28, a tapper controller 30, acoustic receiver 32, centralizing module 6, telemetry module 8, and/or the like may be disposed. Without limitation, acoustic receiver 32 may be disposed at any location within inspection device 4. Housing 60 may be any suitable length in which to protect and house the components of inspection device 4. In embodiments, housing 60 may be made of any suitable material to resist corrosion and/or deterioration from a fluid. Suitable material may be, but is not limited to, titanium, stainless steel, plastic, and/or any combination thereof. Housing 60 may be any suitable length in which to properly house the components of inspection device 4. For example, a suitable length may be about one foot to about ten feet. Additionally, housing 60 may have any suitable width. For example, the width may include a diameter from about one inch to about three inches or about three inches to about six inches. Housing 60 may protect memory module 28, tapper controller 30, and/or the like from the surrounding downhole environment within tubing 12.

As illustrated in FIG. 1, memory module 28 may be disposed within inspection device 4. In embodiments, memory module 28 may store all received, recorded and measured data and may transmit the data in real time through a communication line in tether 16 to a remote location such as an operator on the surface. Memory module 28 may comprise flash chips and/or RAM chips, which may be used to store data and/or buffer data communication. Additionally, memory module 28 may further comprise a transmitter, processing unit and/or a microcontroller. In embodiments, memory module 28 may be removed from inspection device 4 for further processing. Memory module 28 may be disposed within any suitable location of housing 60 such as about the top, about the bottom, or about the center of housing 60. In embodiments, memory module 28 may be in communication with tapper controller 30 and acoustic receiver 32 by any suitable means such as a communication line 34. In embodiments, an information handling system 62, discussed in further detail below, may be disposed in inspection device 4 and communicate with memory module 28 through tether 16. Information handling system 62 may analyze recorded acoustic waves to determine properties of tubing 12, casing 14, cement 56, and/or formation 58. In embodiments, information handling system 62 may be disposed within inspection device 4 and may transmit information through tether 16 to service device 10.

Tapper controller 30, as illustrated in FIG. 1, may control tapper 17. Tapper controller 30 may be pre-configured at the surface to take into account the downhole logging environment and specific logging cases, which may be defined as a static configuration. It may also be dynamically configured by what acoustic receiver 32 may record. Tapper controller 30 may be disposed at any suitable location within housing 60. In embodiments, such disposition may be about the top, about the bottom, or about the center of housing 60.

As illustrated in FIG. 1, tapper 17 may generate a nonlinear acoustic wave, which may be directed into surrounding tubing 12 and/or casing 14. The acoustic wave that may be transmitted back from tubing 12 and/or casing 14 may be sensed and recorded by acoustic receiver 32. In embodiments, the recorded acoustic wave may allow identification of the properties of tubing 12 and/or casing 14, discussed below. It should be noted that properties of a plurality of casing 14, outside tubing 12, and cement 56 between each of the plurality of casing 14 may be determined from the recorded acoustic wave. Tapper 17 and acoustic receiver 32 may be disposed at any suitable location within housing 60, referring to FIG. 1. Such disposition may be at about the top, about the bottom, or about the center of housing 60. Additionally, there may be a plurality of acoustic receiver 32 disposed throughout housing 60.

FIGS. 3-6 illustrate different recorded nonlinear signals that may be used to determine properties of tubing 12, casing 14, and/or cement 56. In embodiments, properties of casing 14, cement 56, and/or interaction between casing 14 and/or cement 56 may be analyzed. Nonlinear acoustic signals may be beneficial for analyses of properties of casing 14, cement 56, and/or the interaction between casing 14 and/or cement 56. This may be due to nonlinear acoustic signals, which may be sensitive to casing 14 and cement 56 interfaces, the density of cement 56, and/or cement 56 and formation 58 interface.

Figure 3:
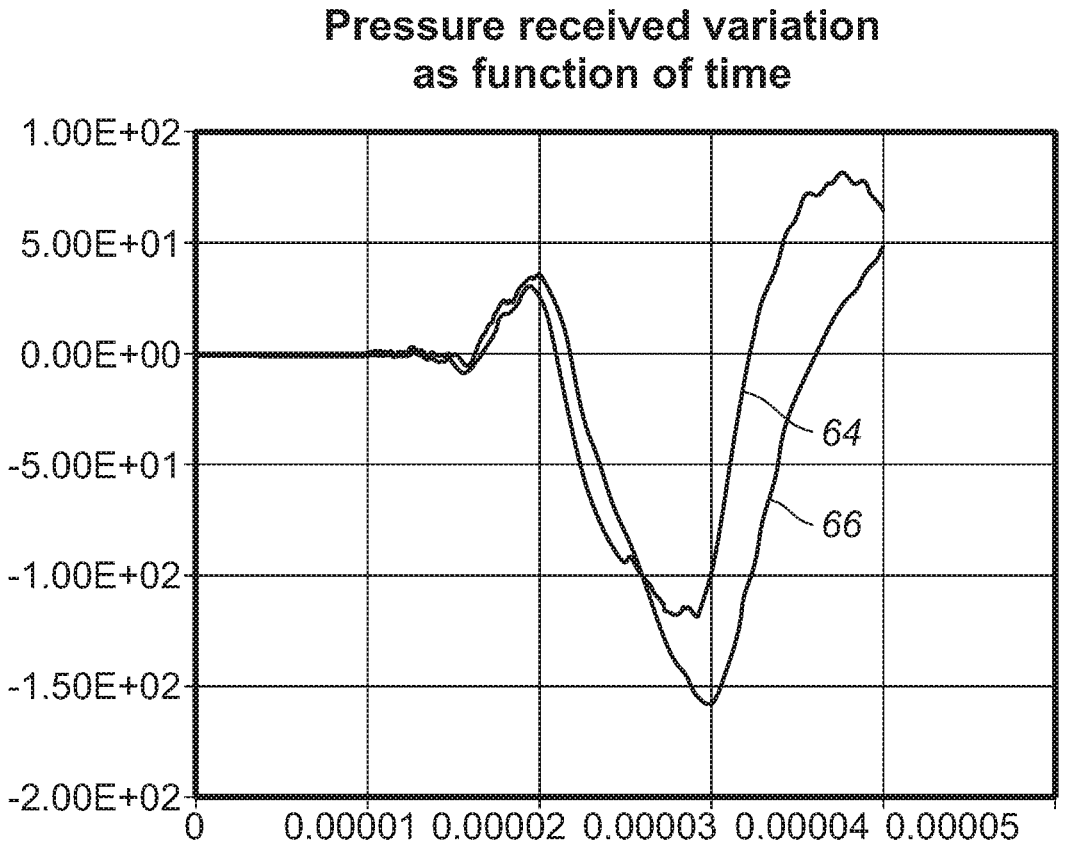
FIG. 3 illustrates a graph of sonic waves using a symmetric impulse configuration.

As illustrated in FIG. 3, when a symmetric impulse configuration is used, the presence of a defect or hole in cement 56 (bad cement) may be determined by evaluating the pressure of the acoustic wave in the fluid. The waveforms are recorded as acoustic amplitude as a function of time. As shown in FIG. 3, the presence of full cement without a hole is recorded as full cement wave 64, which has an amplitude different from the amplitude of bad cement wave 66. This may be due to the fact that nonlinear acoustic waves may not be reflected back to acoustic receiver 32, as voids between casing 14 and cement 56 may absorb and/or scatter nonlinear acoustic waves.

Figure 4:
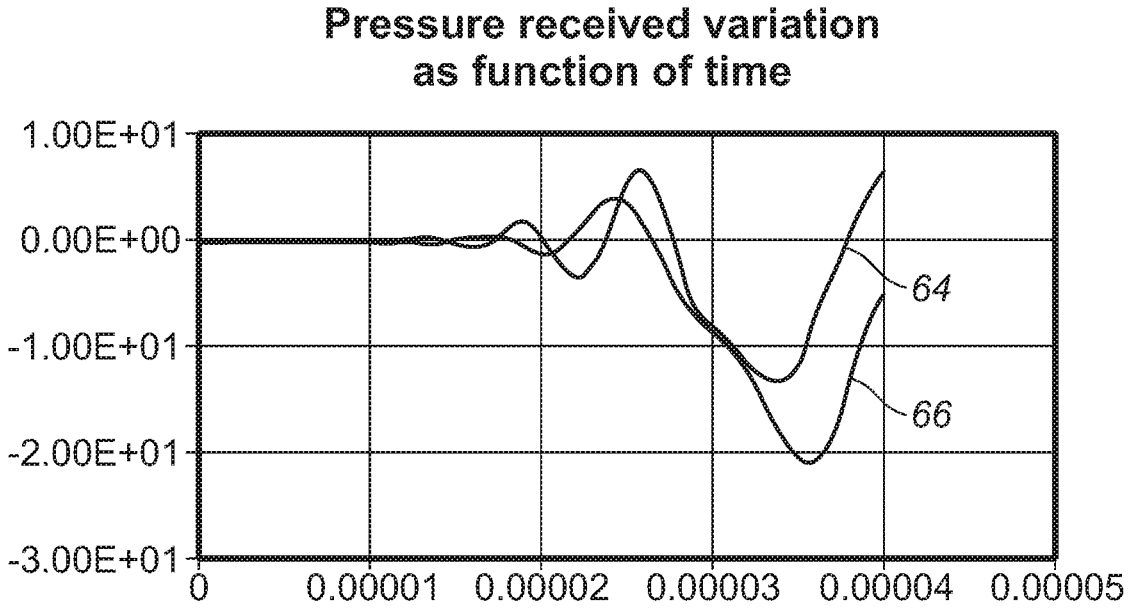
FIG. 4 illustrates a graph of sonic waves using an asymmetric impulse configuration.

As illustrated in FIG. 4, when an asymmetric impulse configuration is used, the pressure inside the propagated acoustic wave in the fluid changes when the acoustic wave encounters a defect or hole in the cement. Once again, the waveforms are recorded as acoustic amplitude as a function of time. As shown in FIG. 4, a full cement wave 64 has an amplitude different from the amplitude of bad cement wave 66. Further, when using an asymmetric impulse configuration, a situation may arise where an acoustic wave is generated at a spot other than where a defect in the cement exists. In order to avoid this situation, a plurality of tapper 17 may be installed with centralizing module 6, and each tapper 17 may be capable of contacting tubing 12 at different times.

Figure 5:
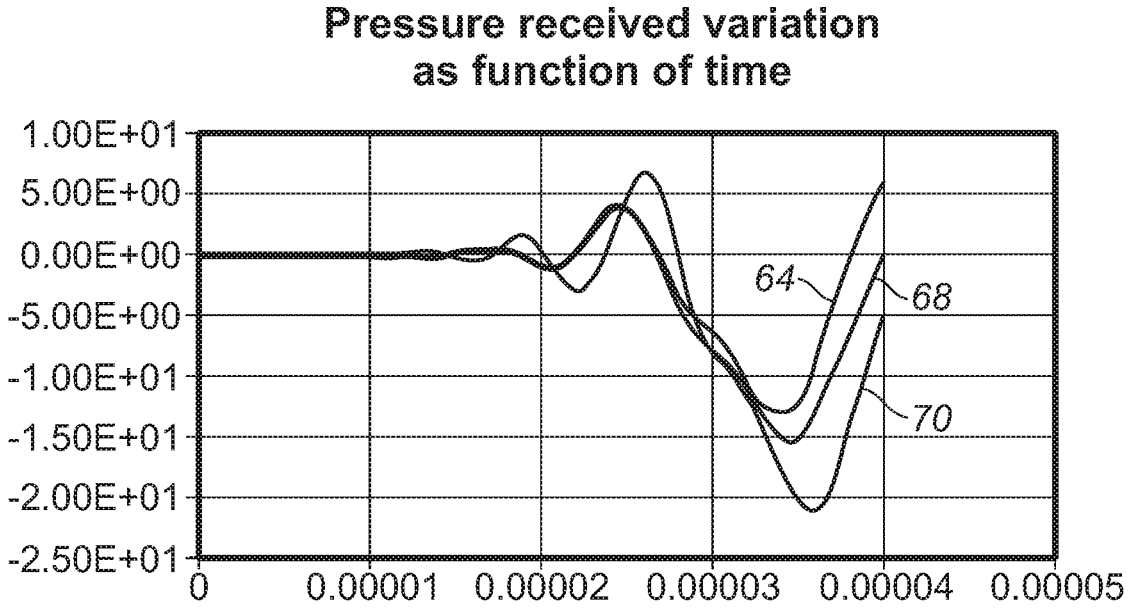
FIG. 5 illustrates a graph of sonic waves using a different sonic aperture.
Figure 6:
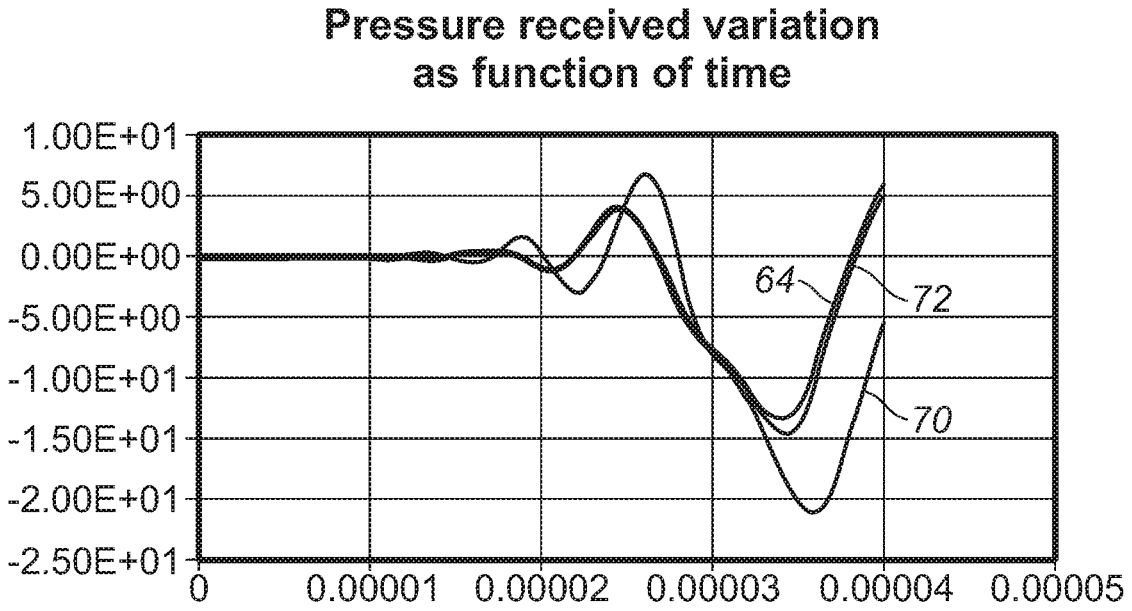
FIG. 6 illustrates a graph of sonic waves using a different sonic aperture.

Additionally, a different acoustic wave aperture generated by tapper 17 may lead to a different resolution or depth of investigation. As illustrated in FIG. 5, full cement wave 64 has a specific amplitude in the graph. A wave indicating bad cement (far) 68 is shown to have a different amplitude in FIG. 5 than full cement wave 64. Further, a wave indicating bad cement (close) 70 is shown to have an amplitude in FIG. 5 different from the wave indicating bad cement (far) 68. Also, as illustrated in FIG. 6, full cement wave 64 has an amplitude different from a wave indicating bad cement (small) 72 and a wave indicating bad cement (close) 70.

Figure 2:
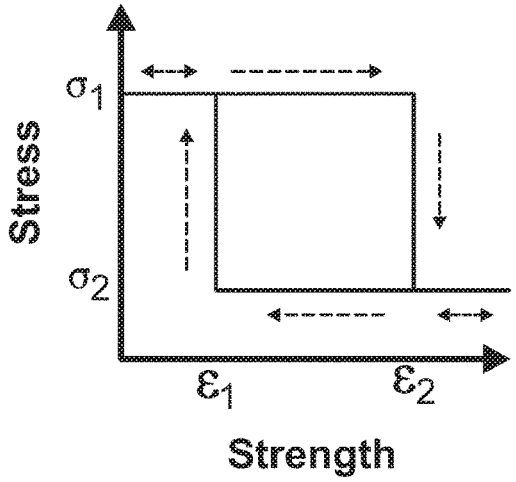
FIG. 2 illustrates a graph of a phenomenological model of hysteresis in cement.

As illustrated in FIG. 1, inspection device 4 may include acoustic receiver 32. Acoustic receiver 32 may sense signals within a frequency range from about 5 kHz to about 100 kHz. Acoustic receiver 32 may comprise a plurality of acoustic receiver 32, which may be disposed in different directions. In embodiments, acoustic receiver 32 may be rotated by a motor (not illustrated), which may allow acoustic receiver 32 to sense signals in different directions. It should be noted that a plurality of acoustic receiver 32 may be rotated by the motor. Tapper 17 may generate acoustic waves, and acoustic receiver 32 may record reflected acoustic waves. Specifically, nonlinear acoustic waves may be generated by tapper 17, and acoustic receiver 32 may further record specific properties of nonlinear acoustic waves which may be reflected from tubing 12, casing 14, and/or cement 56. Recorded nonlinear acoustic waves may be used to identify characteristics of tubing 12, casing 14, and/or cement 56, referring to FIG. 1. Nonlinear acoustic waves may further be generated, directed, and focused within a desired area. FIG. 2 illustrates graphically the phenomenological model of hysteresis in cement 56 with an instantaneous transition as pressure may be applied to cement 56 and the effects on stress and strength of cement 56. For example, a nonlinear acoustic wave may press against tubing 12, casing 14, and/or cement 56. On a micro-level, this may cause movement within tubing 12, casing 14, and/or cement 56. Reflected nonlinear acoustic waves from the movement of tubing 12, casing 14, and/or cement 56 may be analyzed for properties in tubing 12, casing 14, and/or cement 56.

Recorded nonlinear acoustic waves may be analyzed by information handling system 62 to determine properties of tubing 12, casing 14, and/or cement 62. Without limitation, information handling system 62 may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, information handling system 62 may be a personal computer, a network storage device, or any other suitable device and may vary in size, shape, performance, functionality, and price. Information handling system 62 may include random access memory (RAM), one or more processing resources such as a central processing unit (CPU) or hardware or software control logic, ROM, and/or other types of nonvolatile memory. Additional components of information handling system 62 may include one or more disk drives, one or more network ports for communication with external devices as well as various input and output (I/O) devices, such as a keyboard, a mouse, and a video display. Information handling system 62 may also include one or more buses operable to transmit communications between the various hardware components.

Certain examples of the present disclosure may be implemented at least in part with non-transitory computer-readable media. For the purposes of this disclosure, non-transitory computer-readable media may include any instrumentality or aggregation of instrumentalities that may retain data and/or instructions for a period of time. Non-transitory computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such as wires, optical fibers, microwaves, radio waves, and other electromagnetic and/or optical carriers; and/or any combination of the foregoing.

Although the present invention and its advantages have been described in detail, it should be understood that various changes, substitutions and alterations may be made herein without departing from the spirit and scope of the invention as defined by the appended claims.

What is claimed is:

1. A method for inspecting cement downhole comprising:
inserting an inspection device inside a tube, wherein the inspection device comprises:
a centralizing module;
a tapper attached to the centralizing module;
a receiver;
a memory module comprising a micro controller unit; and
a telemetry module;
actuating the tapper, wherein the tapper produces a nonlinear wave;
recording reflections of acoustic waves off a tubing or a casing; and
creating a graph with an information handling system for analysis.

2. The method of claim 1, wherein the centralizing module further comprises an arm with a wheel.

3. The method of claim 1, wherein the centralizing module further comprises a springbow centralizer.

4. The method of claim 1, wherein the tapper is mechanically actuated.

5. The method of claim 1, wherein the tapper is electrically actuated.

6. The method of claim 1, wherein the tapper is symmetrically oriented.

7. The method of claim 1, wherein the tapper is asymmetrically oriented.

8. A method for inspecting concrete downhole comprising:
inserting an inspection device inside a tube, wherein the inspection device comprises:
a centralizing module;
a tapper attached to the centralizing module;
a receiver;
a memory module comprising a micro controller unit; and
a telemetry module;
actuating the tapper, wherein the tapper produces a nonlinear wave; and
recording reflections of acoustic waves off a tubing or a casing.

9. The method of claim 8, wherein the centralizing module further comprises an arm with a wheel.

10. The method of claim 8, wherein the centralizing module further comprises a springbow centralizer.

11. The method of claim 8, wherein the tapper is mechanically actuated.

12. The method of claim 8, wherein the tapper is electrically actuated.

13. The method of claim 8, wherein the tapper is symmetrically oriented.

14. The method of claim 8, wherein the tapper is asymmetrically oriented.

15. An inspection device comprising: a centralizing module; a tapper attached to the centralizing module, wherein the tapper is actuated to produce a nonlinear wave; a receiver; an information handling system; and a memory module comprising a micro controller unit; wherein reflections of acoustic waves off a tubing or a casing are recorded.

16. The device of claim 15, wherein the tapper is mechanically actuated.

17. The device of claim 15, wherein the tapper is electrically actuated.

18. The device of claim 15, wherein the tapper is symmetrically oriented.

19. The device of claim 15, wherein the tapper is asymmetrically oriented.

20. The device of claim 15, wherein the centralizing module further comprises an arm with a wheel.

* * * * *